United States Patent [19]

DeFranco

[11] Patent Number: 4,979,742

[45] Date of Patent: Dec. 25, 1990

[54] TENNIS BALL HOLDER

[76] Inventor: Jack E. DiFranco, 1077 River Rd., Edgewater, N.J. 07020

[21] Appl. No.: 435,484

[22] PCT Filed: Apr. 11, 1988

[86] PCT No.: PCT/US88/01177

§ 371 Date: Oct. 10, 1989

§ 102(e) Date: Oct. 10, 1989

[87] PCT Pub. No.: WO88/08732

PCT Pub. Date: Nov. 17, 1988

Related U.S. Application Data

[63] Continuation-in-part of Ser. No. 46,164, May 7, 1987, Pat. No. 4,815,738.

[51] Int. Cl.[5] ..... A63B 61/00

[52] U.S. Cl. ..... 273/29 R; 273/73 R; 294/19.2

[58] Field of Search ..... 273/29 R, 29 A, 32 B, 273/32 F, 73 R, 73 J, 162 E; 294/19.2

[56] References Cited

U.S. PATENT DOCUMENTS

| | | | |
|---|---|---|---|
| 1,830,520 | 11/1931 | Moyses | 294/19.2 |
| 3,401,970 | 9/1968 | Russell | 294/19.2 |
| 3,405,408 | 10/1968 | Balcer | 273/32 B |
| 3,412,897 | 11/1968 | Slater | 294/19.2 |
| 3,870,300 | 3/1975 | Amendola | 273/32 B |
| 3,874,666 | 4/1975 | Ross | 273/73 R |
| 4,090,298 | 5/1978 | Rushforth | 273/32 B |
| 4,114,881 | 9/1978 | Norton | 273/73 R |
| 4,210,327 | 7/1980 | Schubert | 273/73 R |
| 4,334,707 | 6/1982 | Phillips | 294/19.2 |

FOREIGN PATENT DOCUMENTS

| | | | |
|---|---|---|---|
| 501523 | 7/1956 | Italy | 294/19.2 |
| 443501 | 3/1936 | United Kingdom | 294/19.2 |
| 2035185 | 6/1980 | United Kingdom | 294/19.2 |

*Primary Examiner*—Theatrice Brown
*Attorney, Agent, or Firm*—Alvin S. Blum

[57] ABSTRACT

A tennis ball holder (1) has flexible petals (4) arranged around a tennis ball receiving recess (10). Nap-catching pins (9) attached to the petals project into the recess. When a tennis ball (21) is forced against the holder, the petals open outwardly, permitting the ball to enter the recess. The pins are then forced elastically into the nap (20) that covers the ball, thereby holding the ball in place. When the ball is manually pulled away, the pins release the nap undamaged and the petals elastically return to their original position. The holder is designed for economical fabrication in one piece. The holder may be attached to the handle end of a tennis racket for retrieving fallen balls without stopping. Alternatively, the holder may be attached to clothing for holding a ball not in use.

18 Claims, 3 Drawing Sheets

TENNIS BALL HOLDER

This is a continuation-in-part of application Ser. No. 07/046,164 filed May 7, 1987, now patent No. 4,815,738.

TECHNICAL FIELD

This invention relates to the technical field of devices for releasably engaging tennis balls and more particularly such devices for the handle end of a tennis racket for picking up balls and for application to the wearing apparel of a tennis player to hold balls not in use.

BACKGROUND ART

Prior art includes U.S. Pat. Nos. 4,210,327: 4,114,881: 3,874,666; 266,598; 802,264; 3,698,720; 4,334,707: 4,398,716; GB Patent No. 2,128,484 and DE 2,254,275. None of the above inventions incorporate the unique structure herein described for a tennis ball holder that is engineered for economical fabrication and efficient function for easily engaging the nap surface of the ball when ball and holder are simply pressed together and for readily releasing the ball from its grasp with a simple pull without damage to ball or holder even in repeated use. Many tennis players have temporary or permanent infirmities that make constant bending to retrieve balls awkward or uncomfortable. A holder affixed to the end of a tennis racket can be used to pick up a fallen ball without stooping. For such an application, the holder should be small and light and constructed so as not to interfere with the ordinary playing functions of the racket. In playing tennis, at least two balls must be available for serving. It would be useful to have a releasable holder attached to the player's clothing to hold one or more balls to leave both hands free for playing, without forcing spare balls into pockets.

DISCLOSURE OF THE INVENTION

It is, accordingly, an object of the invention to provide a tennis ball retrieving device for the handle end of a tennis racket that will effectively engage the ball when the handle end is pressed onto the ball, and that will release the ball manually without effort or damage to the ball.

It is an object to provide a tennis ball grasping or holding device that will not deteriorate with use, and with contamination from the environment.

It is yet another object of the invention to provide said ball grasping or holding device that will be of such small dimensions and weight as to not adversely affect the use of the racket.

It is yet another object to provide, in one embodiment of the invention, said ball holding device that may be readily attached to the handle.

It is yet another object to provide, in another embodiment, a ball holding device that forms a part of the grip of the handle.

It is yet another object to provide, in another embodiment, a tennis racket incorporating said ball holding device.

It is yet another object of the invention to provide an easily releasable tennis ball holding device that can be attached to the wearing apparel of the tennis player for holding a spare tennis ball to relieve the player of the need to carry a spare ball in hand or pocket. In one embodiment the holder is attached to a spring clip which is adapted to engage the waistband of the tennis shorts, skirt or trousers. In another embodiment the holder is attached to a loop through which a belt may be passed.

The device of the invention includes a base and a plurality of petals flexibly joined at said base. The base has attaching means for attaching to a racket handle or is affixed to clothing engaging means to be worn by the player. The petals bear nap-catching pins. Each petal is joined at a first end to the base and is movable at a second, opposite end. The petals are arranged about the perimeter of the base with said second ends directed away from said racket to form a substantially cup-shaped recess with readily distendable walls. The nap-catching pins are on the surface of each petal that is directed inwardly towards the center of the cup. The petals and their attachments have sufficient flexibility that they will open outwardly when the recess is centered over a tennis ball and forced down upon it. Because the recess has a diameter less than that of the ball, each petal will, by virtue of the aforementioned flexibility bend outwardly and its inner, pin-bearing surface will engage the nap of the ball, holding it firmly even though the greatest diameter of the open petals will not extend around the ball to its diameter. When not applied to a ball, the petals will elastically return to their relaxed, or closed, state with a minimal diameter that is small enough to not interfere with normal operation of the racket.

It is yet another object to provide a holder that can be economically molded of a springy plastic in one piece by a simple molding operation.

Pig. 9 shows in cross section a molded belt loop for attaching to a holder of the invention to carry the holder on a belt.

BEST MODE FOR CARRYING OUT THE INVENTION AND INDUSTRIAL APPLICABILITY

Figure 3:
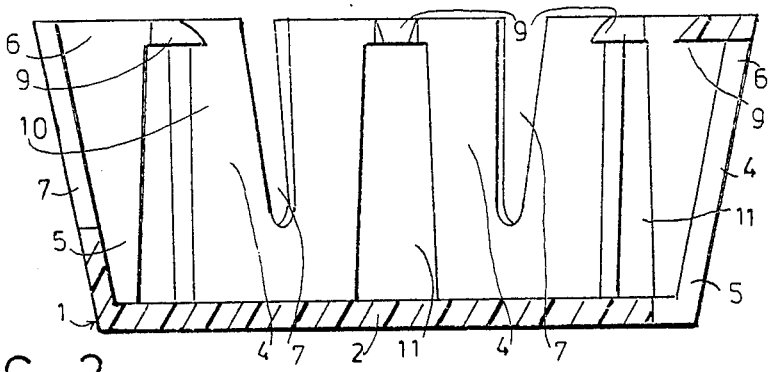
FIG. 3 is a front elevation sectional view taken along the plane of line 3—3 of FIG. 1, and looking in the direction of the arrows.
Figure 1:
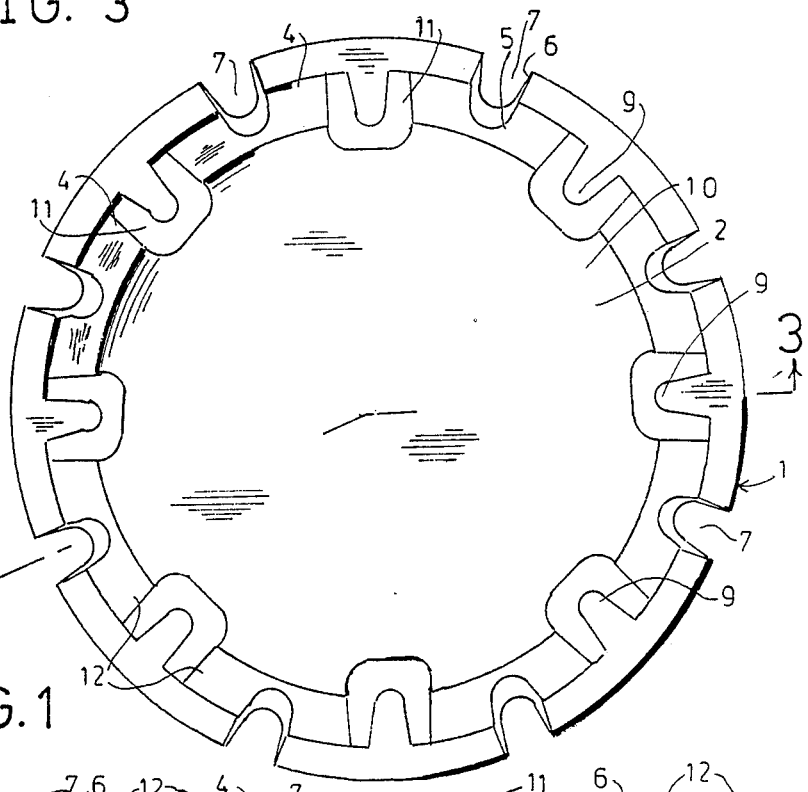
FIG. 1 is a top plan view of an embodiment of the invention.
Figure 2:
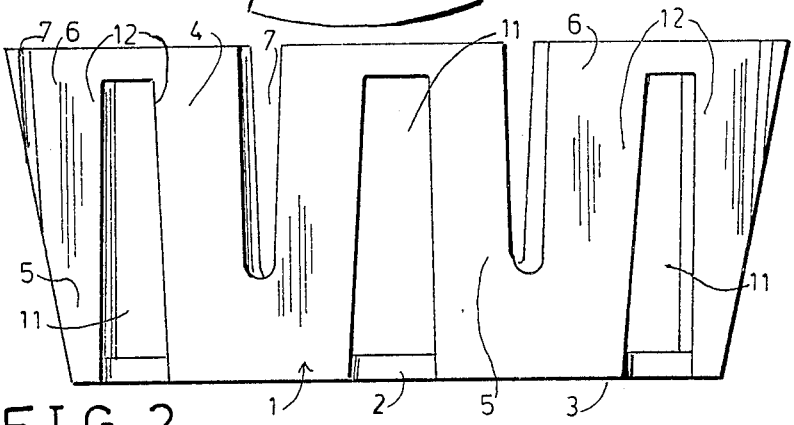
FIG. 2 is a front elevation view of the device of FIG. 1.

Referring now to the drawings in greater detail, FIGS. 1-3 illustrate a device 1 of the invention having a base 2 in the form of a disc. The lower surface 3 of the base 2 is attached to the end of the handle of a tennis racket by attaching means well known in the art including adhesives, screws and the like. Petals 4 are joined at a first end 5 to base 2. Petals 4 are freely movable at a second end 6. Molded slots 7 separate the movable second ends 6 of the petals when the device is molded in one piece as shown here. Nap-catching pins 9 are molded into the inwardly-facing surfaces of petals 4.

This device is firmly attached to the end of the handle of a tennis racket. To pick up a fallen tennis ball without stooping, the racket is grasped by the frame end, the device is positioned over the ball, and forced down onto the ball. As the ball moves into the recess 10 formed by the encircling petals, the petals 4 are forced outwardly by the ball at their second ends like the blooming of a flower. The device, or at least the petals, are formed of an elastic material to permit them to bend outwardly to an open position and to have sufficient elastic memory to enable them to return to a closed inward position when the ball is removed so that the device has a smaller outside diameter and thereby disturbs the dimensions and playing performance of the racket less.

The elastic memory also causes the petals to press against the ball, causing nap-engaging pins 9 to be forced against the surface of the ball. The pins are small enough to penetrate the nap of fibers covering the ball, thereby engaging the ball with sufficient tenacity to enable the user to lift up the ball with the racket. The flexibility of the petals enables the user to pull the ball free manually without damage to the device or the ball.

The apertures 11 in the petals 4 below the pins 9 provide a means for molding the pins and the entire device in one piece with a simple two-piece mold using a straight-line opening and closing of the mold. The aperture 11 in petal 4 also makes the petal more flexible by removing petal material, so that it has two narrow legs 12, separated by the aperture 11.

Figure 4:
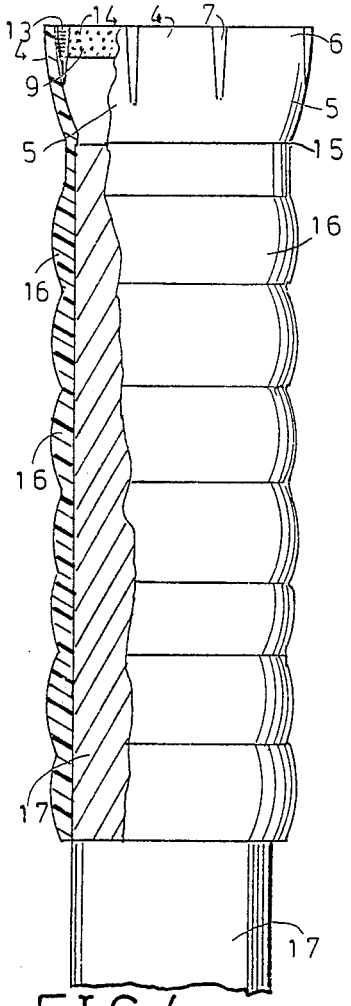
FIG. 4 is a fragmentary front elevation view of another embodiment of the invention on the handle of a tennis racket formed in combination with the handle grip.

Each petal is shown bearing a single pin 9. However, each petal may bear a plurality of pins. FIG. 4 illustrates an embodiment of the invention wherein each petal 4 bears a plurality of pins 9 shown in side view at 13 and end on at 14. These many fine pins may be molded into the petals. Alternatively, they may be molded into a support that is later affixed to the petal 4 at the free end 6. Alternatively, these pins may be the hook portion of hook and loop fastener means trademarked VELCRO. The petals 4 of FIG. 4 are joined at their lower ends 5 to a circumferential base 15 that is a part of the tennis racket grip 16 that is attached to the tennis racket 17, shown here partially broken away. The holder, grip and racket may be manufactured together. The holder and grip may be manufactured together for fitting onto a racket.

Figure 5:
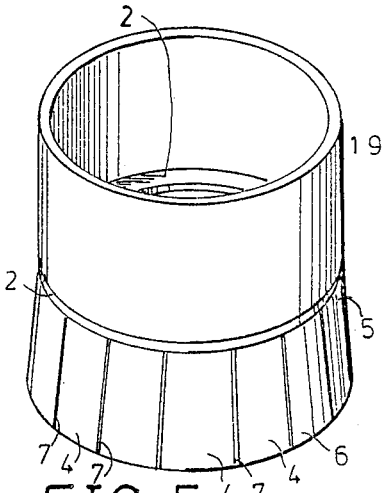
FIG. 5 is a perspective view of another embodiment of the invention for sliding over the end of a raquet.
Figure 6:
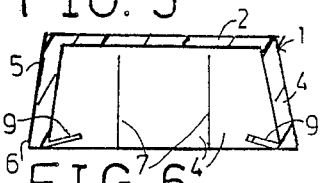
FIG. 6 is a front elevation sectional view of the device with angled pins.
Figure 7:
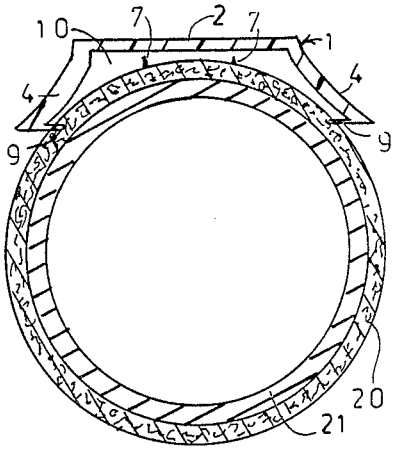
FIG. 7 shows diagrammatically the device of FIG. 6 interacting with a tennis ball.

Alternatively, the holder such as shown in FIGS. 1–3 may be affixed to the end of a racket. The holder of FIG. 5 includes a thin sleeve 19 with a ring-like base 2 supporting the petals, that are separated from each other by slots 7. The sleeve 19 is slipped over the handle end of the racket for securing the device to a racket. The holder of FIGS. 6 and 7 has nap-catching pins 9 attached to petals 4 at such an angle that, when the petals are "opened" as in FIG. 7 by forcing onto a tennis ball, the pins will point inwardly to better grip the nap 20 of tennis ball 21. The tennis ball referred to is a regulation U.S. Lawn Tennis Association tennis ball.

The base 2 of holder 1 may be affixed to a tennis racket handle by adhesive means. Alternatively, the holder may be affixed by a separate fastener such as a screw.

Figure 8:
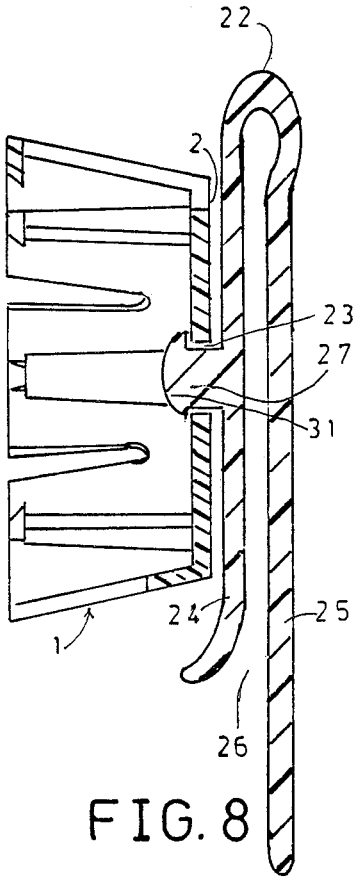
FIG. 8 shows in cross section a tennis ball holder in combination with a spring clip for clipping onto the waistband of tennis shorts or skirts.
Figure 9:
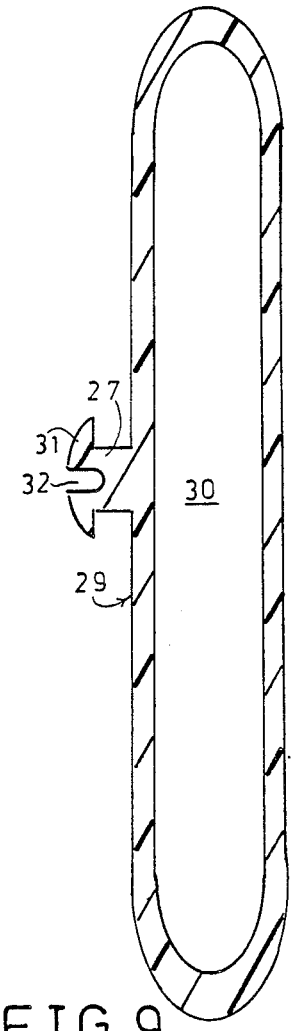

The holder 1 shown in FIG. 8 has a hole 23 in its base 2 for passage of a fastener 27. In this drawing it is shown attached to a spring clip 22 made of a springy plastic with a first leg 24 and a second leg 25 defining a springably adjustable space 26 therebetween for engaging the waistband of tennis shorts, skirts, belts, trousers and the like. The head 31 of fastener 27 may be formed by heat, pressure and the like such as heat or ultrasonic staking after its insertion into hole 23 in base 2. Alternatively, holder 1 may be permanently affixed to a closed loop 29 as shown in FIG. 9. Such a loop provides for passage of a belt through aperture 30.

The preformed head 31 of fastener 27 has a slot 32 so that the head will snap into the hole 23 in base 2 of the holder. The tennis player can comfortably carry one or more holders at his waist with the spring clip or belt loop where tennis balls can be conveniently carried without interfering with the game in any way.

The above disclosed invention has a number of particular features which should preferably be employed in combination although each is useful separately without departure from the scope of the invention. While I have shown and described the preferred embodiments of my invention, it will be understood that the invention may be embodied other wise than as herein specifically illustrated or described, and that certain changes in the form and arrangement of parts and the specific manner of practicing the invention may be made within the underlying idea or principles of the invention within the scope of the appended claims.

What is claimed is:

1. A tennis ball holder for removably grasping a regulation tennis ball by forcing together a tennis ball having a particular diameter and a nap surface and said holder characterized by: a one-piece molded cup having substantially the shape of a frustum of a cone with a substantially flat base at a smaller first end, a substantially conical slotted wall extending from the perimeter of said base to an open, larger, second end, said slotted wall including a plurality of first slots and second slots; said first slots coextensive with said open, second end and extending axially from said second end toward said base, each adjacent pair of said first slots defining a portion of wall therebetween having the form of a petal attached at said base and movable at said open end so that said petals forming said wall can spread apart at said open end when said open end is forced against said ball with sufficient elasticity to retract when said ball is removed, thereby providing said wall with an expansible diameter at said open end;

at least one nap-engaging tooth means on said wall for releasably engaging said nap surface coextensive with each said petal at said open end and extending radially and inwardly into said cup for holding said ball in place;

each of said second slots originating in said base and extending axially in said petal toward said open end and terminating at said nap-engaging tooth means, said second slot thereby providing means for molding said holder in one piece with a die with a simple rectilinear open and closing motion, said second slots further enhancing the flexibility of said petals.

2. The holder according to claim 1, in which the diameter of a said open end is less than the diameter of a said ball.

3. The holder according to claim 1, in which said tooth means includes hook and loop material.

4. The holder according to claim 1, in which said base means includes wearing apparel attaching means for attaching to the clothing of a tennis player.

5. The holder according to claim 4, in which said wearing apparel attaching means includes a spring clip.

6. The holder according to claim 4, in which said wearing apparel attaching means includes a closed loop.

7. A tennis ball holder for removably grasping a regulation tennis ball having a nap surface by forcing said holder and said ball together characterized by: a one piece molded cup with a substantially flat base at a first end;

a substantially cylindrical wall extending from said first end to a second, open end for receiving a portion of said ball;

a plurality of first slots in said wall substantially parallel to each other, originating at said open end and extending toward said base, said first slots thereby defining a plurality of elastic petals joined at said base and free to elastically open out at said open end when said open end is forced over said ball, thereby providing said wall with an expansible diameter at said open end;

at least one nap-engaging tooth means at the open end of each said petal, said tooth means connected at its base to said petal and extending radially toward the axis of said cup for releasably engaging the nap covering said ball.

8. The holder according to claim 7, in which said wall further includes at least one second slot in each petal, said second slot originating in said base, extending toward said open end and terminating at said tooth means for easier fabrication by a simple molding process.

9. The holder according to claim 8, in which said base includes wearing apparel attaching means for attaching to the clothing of a tennis player.

10. The holder according to claim 7, in which said tooth means includes hook and loop material.

11. The holder according to claim 7, in which said base means includes wearing apparel attaching means for attaching to the clothing of a tennis player.

12. The holder according to claim 11, in which said wearing apparel attaching means includes spring clip means.

13. The holder according to claim 11, in which said wearing apparel attaching means includes a closed loop.

14. The holder according to claim 7, in which the diameter of a said open end is less than the diameter of a said ball.

15. The holder according to claim 14, in which said tooth means includes hook and loop type fastener material.

16. The holder according to claim 14, in which said base includes wearing apparel attaching means for attaching to the clothing of tennis player.

17. The holder according to claim 16, in which said wearing apparel attaching means includes spring clip means for attaching to wearing apparel.

18. The holder according to claim 16, in which said wearing apparel attaching means includes a closed loop.

* * * * *